US006918533B2

(12) United States Patent
Canino

(10) Patent No.: US 6,918,533 B2
(45) Date of Patent: Jul. 19, 2005

(54) HANDLED CONTAINER

(75) Inventor: Paul A. Canino, Loveland, OH (US)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 10/608,165

(22) Filed: Jun. 26, 2003

(65) Prior Publication Data

US 2004/0262375 A1 Dec. 30, 2004

(51) Int. Cl.[7] ..... B65D 5/46
(52) U.S. Cl. ..... 229/117.23; 229/117.24
(58) Field of Search ..... 229/117.25, 125.01, 229/125.15, 117.24, 117.23, 117.29

(56) References Cited

U.S. PATENT DOCUMENTS 3,481,528 A * 12/1969 Linda et al. ..... 229/117.24
4,669,627 A * 6/1987 Ueda et al. ..... 229/117.23
4,804,134 A * 2/1989 Reil ..... 229/117.23
D437,218 S 2/2001 Ljunstrom et al.
6,182,887 B1 2/2001 Ljunstrom et al.
6,357,203 B1 3/2002 Cicha et al.

FOREIGN PATENT DOCUMENTS

JP 7-89536 * 4/1995 ..... B65D/5/74

* cited by examiner

*Primary Examiner*—Tri M. Mai
(74) *Attorney, Agent, or Firm*—Melvin D. Fletcher

(57) ABSTRACT

A container of the gable top variety having a handle which resides within the bounds of the footprint of the container while further providing for the placement of a pouring spout on the top end of the container. In accordance with a further aspect of the invention, the container is formed from a flat blank of a paperboard-containing material having foldable panels which, when folded, define the gable top of the container, one of the two major panels of the defined top being larger that the second of these major panels and further being oriented at an angle with respect to the vertical which is different from the angle of orientation of the second major panel. In the present container, the pouring spout is disposed on the second (smaller) major panel and the handle is disposed on the larger of the two major panels. The handle of the present container may be formed integrally with the blank or attached to the partially or fully erected container.

17 Claims, 8 Drawing Sheets

HANDLED CONTAINER

RELATED APPLICATIONS

Not Applicable

FIELD OF INVENTION

This invention relates to containers, particularly containers formed from paperboard, laminates including paperboard, or polymeric materials (commonly laminates of differing polymeric materials).

BACKGROUND OF INVENTION

The common "gable-top" container for food products, and other pourable products, provides a top which is readily opened for the discharge of the container contents. Gable-top containers commonly include at least two top outer exposed panels whose body portions define the characteristic "gable" on the top end of the container and whose distal edges are bonded to define a fin which is readily openable to expose substantially the entire cross sectional area of the top opening of the container for the removal of the contents through such opening.

The afore described container design has long been considered very desirable for containing pourable products. Of recent, this container has been modified to provide a pouring spout disposed within the bounds of one of the top outer panels. This spout desirably limits the outflow of liquid, for example, from the container and is provided with outer threads for the receipt of a closure cap thereon. This structure continues to gain popularity in part because of the ease of opening and closing of the container.

In each of these prior art containers, the body of the container is tubular in form. To lift the container for whatever reason requires that one grasp the container about its middle with one or both hands. If both hands are used to lift the container, the cap closing the pouring spout must be removed before the container is lifted and tilted to pour from it. If only one hand is used to lift the container, a second hand may be used to remove the cap, but only at the risk of the container inadvertently tilting while held in a single hand, and resultant accidental spilling of the container contents.

Handles placed on the exterior sides of the common gable-top container are most undesirable due to problems associated with packing of the containers in shipping cartons, stacking the containers on shelves in retail stores, and the ever-present tendency of the handles on the side to be damaged in handling, transporting, etc. Very importantly, handles on the sides of the containers preclude the use of currently existing, and very expensive, machines employed in erecting blanks into tubular containers, and filling the containers with product, for example.

SUMMARY OF INVENTION

In accordance with one aspect of the present invention, the present inventor provides a gable top container with a handle which resides within the bounds of the footprint of the container while further providing also for the placement of a pouring spout on the top end of the container. In accordance with a further aspect of the invention, the container is formed from a flat blank of a paperboard-containing material having foldable panels which, when folded, define the gable top of the container, one of the two major panels of the defined top being larger that the second of these major panels and further being oriented at an angle with respect to the vertical which is different from the angle of orientation of the second major panel. In the present container, the pouring spout is disposed on the second (smaller) major panel and the handle is disposed on the larger of the two major panels. The handle of the present container may be anchored at its opposite ends to the partially or fully erected container. In one embodiment, the handle includes a planar base which is disposed internally of the container with the handle projected outside the container via an opening through the major planar panel of the gable top of the container.

BRIEF DESCRIPTION OF THE FIGURES

FIGS. 11A, 11B, 11C, 11D, 1E, and 11F are perspective views of alternative embodiments of a handle suitable for use with the container depicted in FIG. 1;

DETAILED DESCRIPTION OF INVENTION

Figure 1:
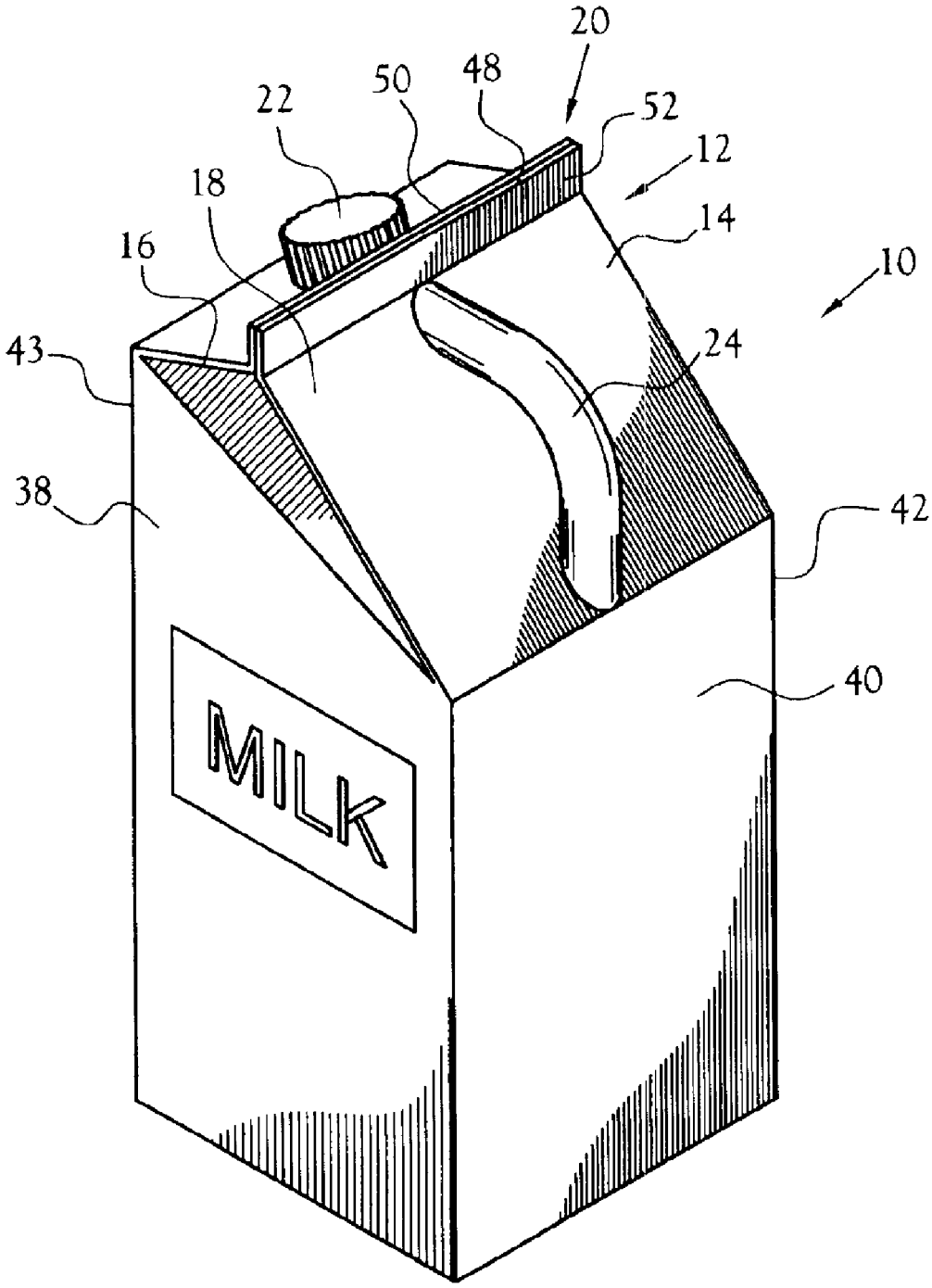
FIG. 1 is a perspective view of a handled container embodying various of the features of the present invention.
Figure 3:
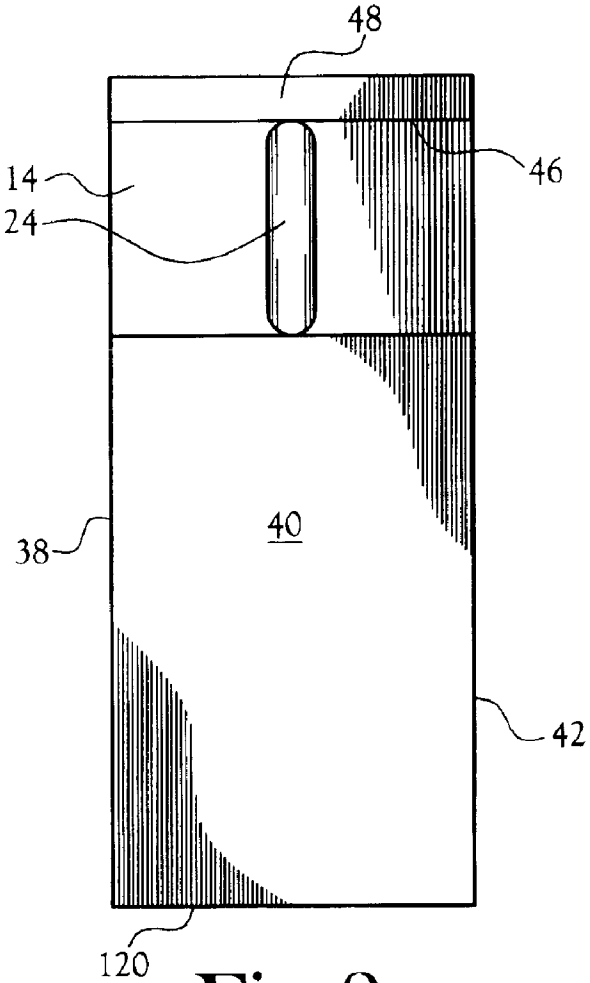
FIG. 3 is a side elevational view of the handle-bearing side of the container depicted in FIG. 1.

With reference to FIG. 1, in accordance with one aspect of the present invention, there is provided a container 10, which in the depicted embodiment, is of generally rectangular overall geometry aside from its top end 12. The top end 12 of the depicted container is defined by a plurality of folded panels, including a major panel 14 and a minor panel 16 which cooperatively define the outer (top) surface 18 of a gable top 20 of the container. In the depicted embodiment, the container includes a pour spout 22 associated with the minor panel and a handle 24 of the present invention associated with the major panel.

Figure 2:
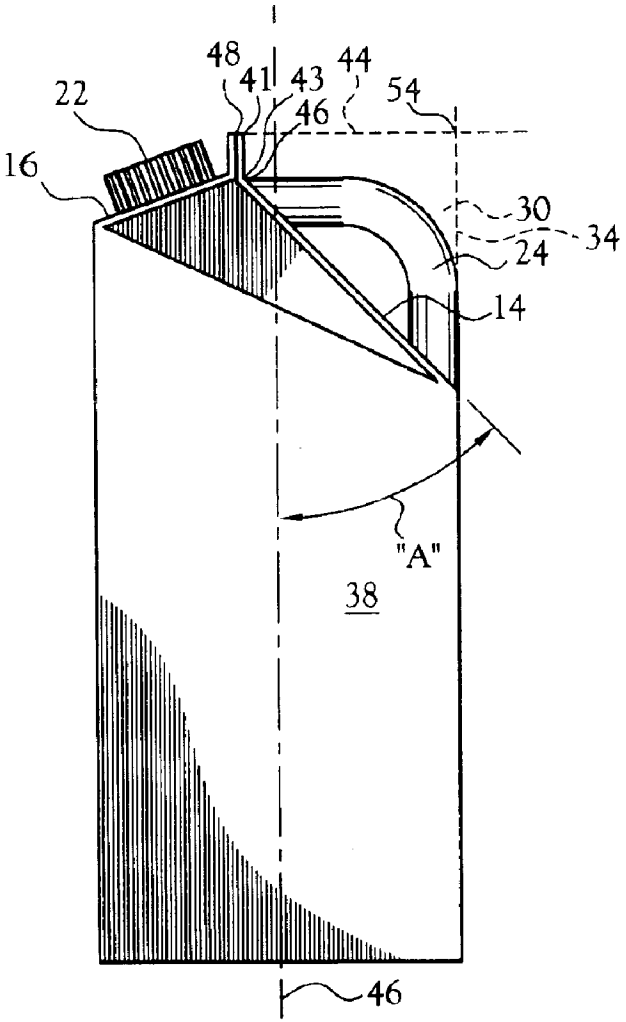
FIG. 2 is a side elevational view of the left side of the container depicted in FIG. 1.
Figure 5:
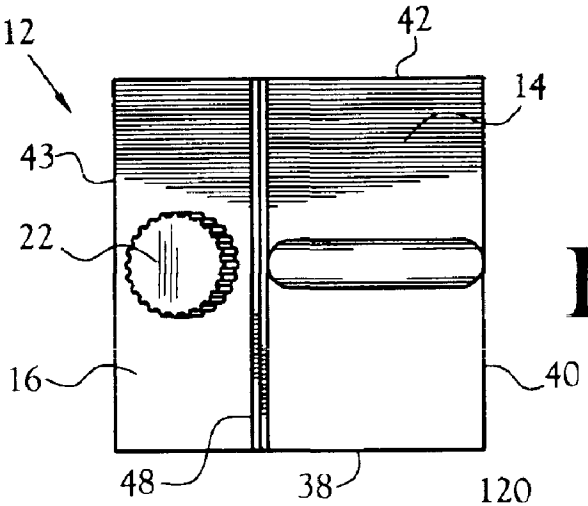
FIG. 5 is a top view of the container depicted in FIG. 1.
Figure 9:
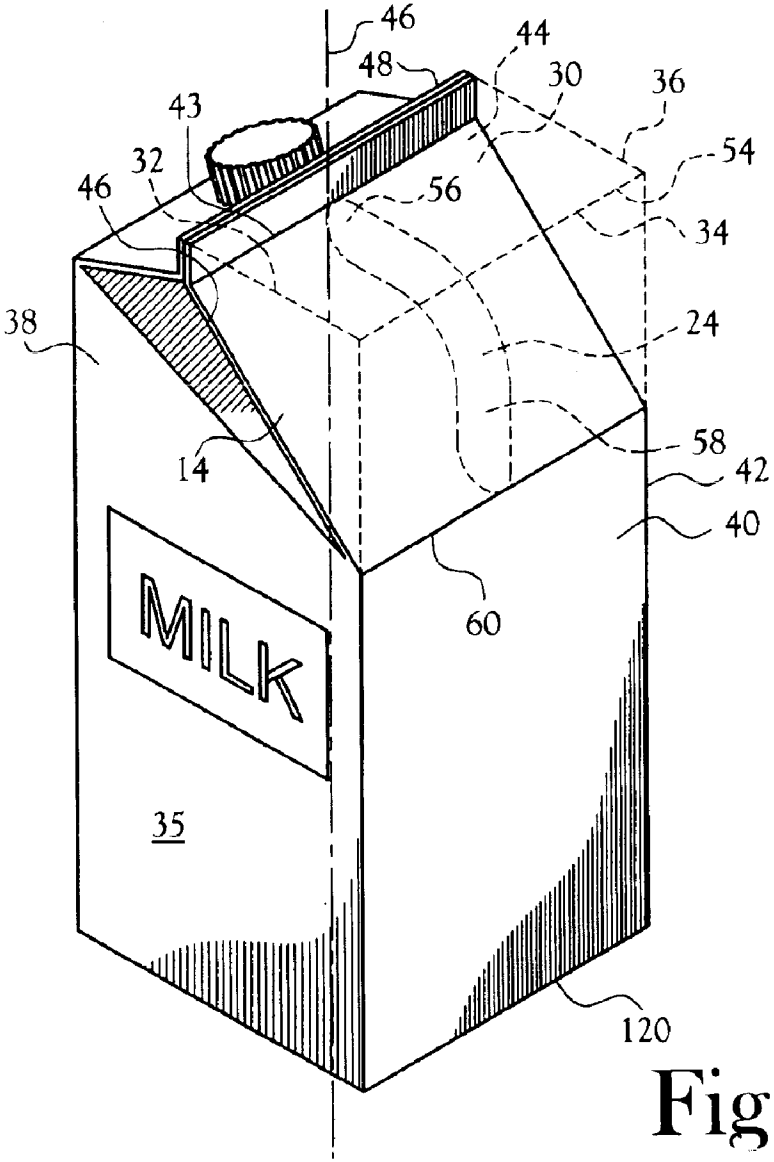
FIG. 9 is a perspective view of a gable top container embodying various of the features of the present invention and depicting, in phantom, an imaginary space within which a handle of the present invention is mounted.
Figure 7:
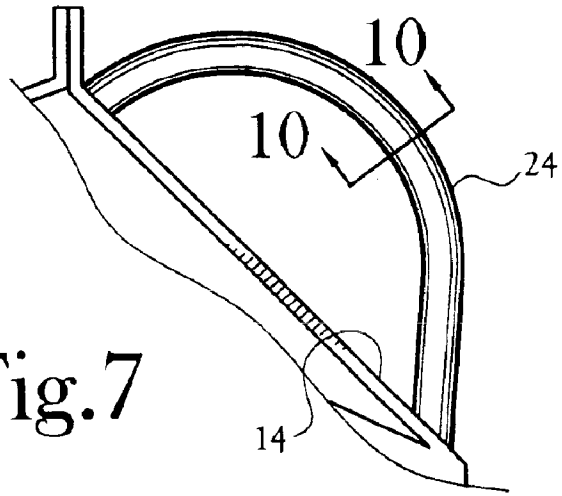
FIG. 7 is a perspective view of one embodiment of a handle suitable for use with the container depicted in FIG. 1.
Figure 8:
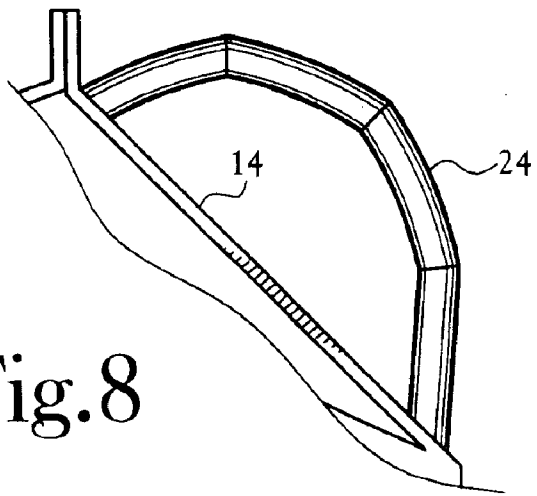
FIG. 8 is a perspective view of a further embodiment of a handle suitable for use with the container depicted in FIG. 1.
Figure 10:
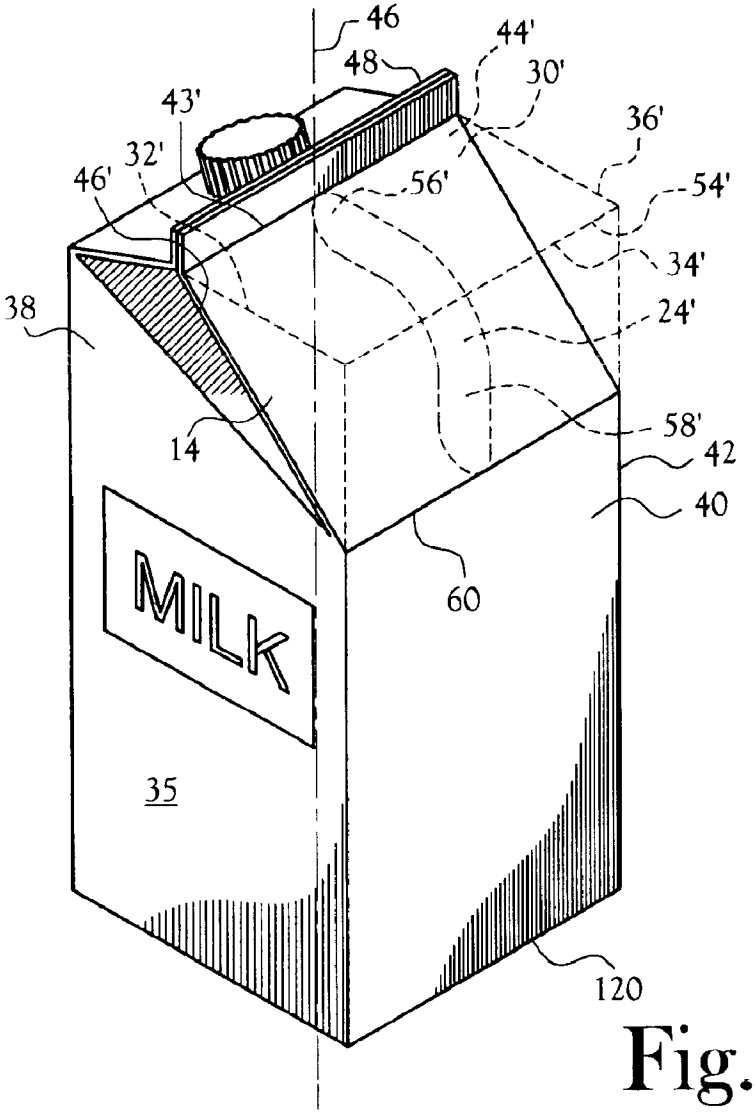
FIG. 10 is a perspective view of a gable top container embodying various of the features of the present invention and depicting, in phantom, an alternative embodiment of the imaginary space within which a handle of the present invention is mounted.

Referring to FIGS. 1, 2 and 9, in accordance with the present invention, there is provided an imaginary space 30 indicated by the dashed lines of FIGS. 2 and 9, within which the handle 24 of the present invention may be located. This imaginary space 30 is defined on the bottom thereof by the plane of the major panel 14 of the gable top 20 of the container, and on the side walls thereof by imaginary extensions 32, 34, 36 of the side walls 38, 40, 42, respectively, and on its top wall an imaginary plane 44 projecting from the top edge 41 of the fin 48 in a direction normal to the centerline 46 of the container. This imaginary plane 44 defines the top of the imaginary space and is intersected by the imaginary extensions 32, 34, and 36 of the side walls. As depicted in a plan view such as FIG. 2, this imaginary space is of generally a truncated triangular cross-section, the apex 46, of the space being parallel to, and coextensive with the top edge 41 of the fin 48 defined at the joiner of the adjacent side margins 50, 56 of the minor and major panels 14,16 of the gable top. Thus, the space increases in depth from the fin to the juncture 54 thereof with the extension 34 of the side wall 40, thereby providing for space for a handle 24. In the embodiment depicted in FIG. 9, the handle includes first and second ends 56, 58 respectively, the first end 56 thereof being anchored to the major panel (or to the major panel and/or the fin), and the second end 58 being anchored to the major panel adjacent the junction 60 of the side edge of the major panel with the top edge of the side wall 40 of the container. It will be recognized that the apex 46 of the imaginary triangular space is depicted as terminated along the top edges of the fin so that the actual cross section of this depicted imaginary triangular space is truncated at its apex, but alternatively the imaginary plane 44 may terminate at the fold line 43 between the major panel 14 and the fin 48, thus creating an imaginary space which is more truly triangular in cross section when viewed in a plan view. This latter embodiment is depicted in FIG. 10 wherein like parts as found in FIGS. 2 and 9 are identified by primed numerals.

Figure 6:
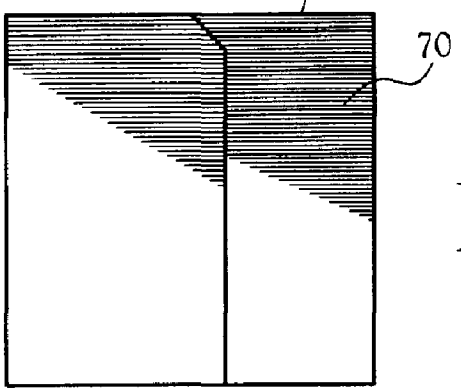
FIG. 6 is a bottom view of the container depicted in FIG. 1.
Figure 4:
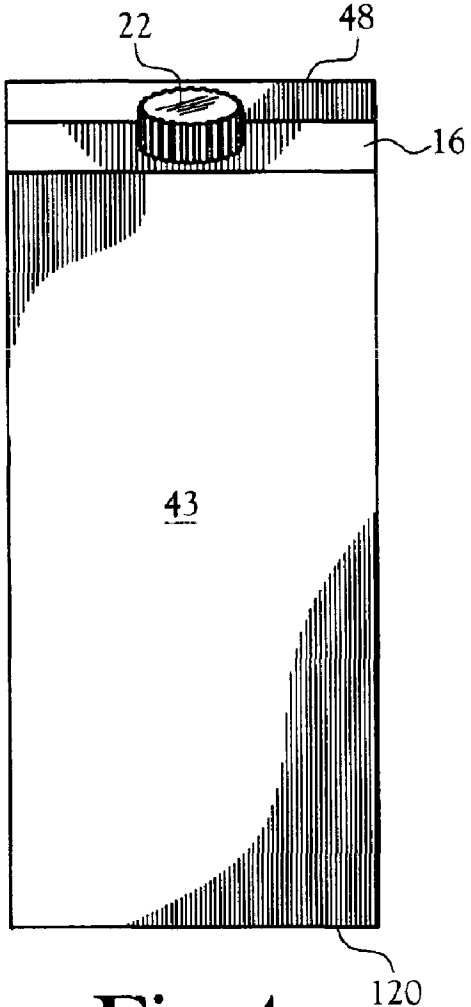
FIG. 4 is a side elevational view of the pouring spout side of the container depicted in FIG. 1.

Notably, the handle of the present invention is of a design which will not extend beyond the extended side 34 of the container nor will it project higher than the top edge of the common sealing fin 48 found on a gable-top container. Neither does the handle project materially laterally beyond the footprint 70 of the container, such footprint being defined by the area of the bottom 120 of the container as depicted in FIG. 6. Accordingly, the handled container of the present invention does not require any greater or non-conventionally shaped, storage space within a shipping case containing a plurality of containers, nor any greater or non-conventional display space in a retail establishment. Very importantly, the present container may be constructed from a blank employing existing conventional machinery. Moreover, it will be recognized by one skilled in the art that the usable internal volume of the handled container may be adjusted merely by lengthening or shortening the height of the container.

As depicted in FIGS. 1, 7, 8, and 9, the handle may assume a curved geometry or may be multi-segmented from end to end thereof. In any event, the arch of the handle shall not cause any material portion of the handle to project beyond the plane 44, nor materially laterally outwardly beyond the extensions of the side walls 38, 40 and 42. In a preferred embodiment, the handle is wholly within the footprint 70 of the bottom of the container. As so positioned, the handle defines an opening 71 between the handle and the planar major panel through which at least multiple fingers, and preferably all four fingers of a user's hand may pass to permit grasping and manipulation of the container (See FIGS. 7 and 8)).

Figure 11A:
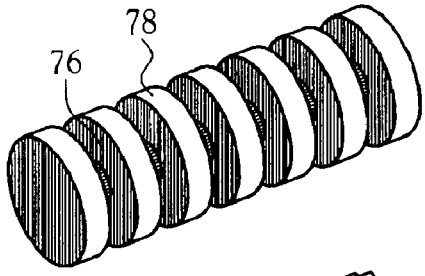
Figure 11B:
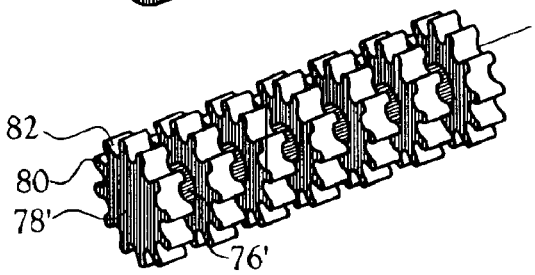
Figure 11C:
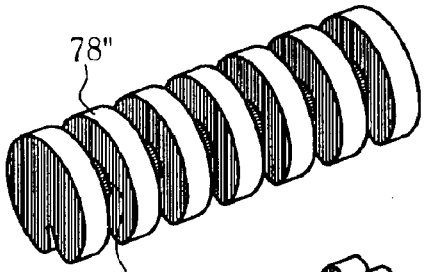
Figure 11D:
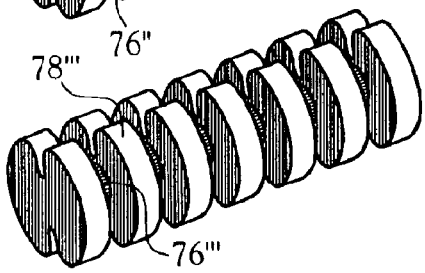
Figure 11E:
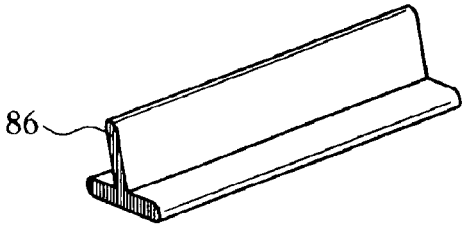
Figure 11F:
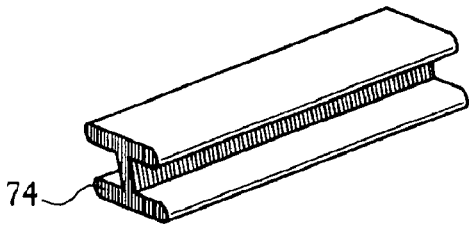

The handle of the present invention may be formed as a solid member of a circular, semi-circular, oval, or other suitable cross-section, as desired. Alternative cross-sections for a suitable handle are depicted in FIGS. 11A–11F wherein it may be seen that the cross-section of the handle may be of an "H" cross-section with the web 74 of the "H" being oriented generally normal to the plane of the major planar panel (FIG. 11F). Or, the handle may comprise a central elongated core 76 with a plurality of discs 78 defined along the length of the core and in spaced apart relationship to one another, the discs being oriented substantially normal to the length of the core 76, as is depicted in FIG. 11A-11D. This basic design of the handled may be modified to include modifications, such as alternating ribs 80 and grooves 82 in the outer periphery 88 of the discs such as the grooves depicted in FIG. 11B which define aberrations in the outer circumferential surface of one or more of the discs. The number of ribs and grooves further may be altered or they may be positioned at different locations about the periphery of the discs to give several other suitable cross-sections for the handle (FIGS. 11C and 11D, for example). Still further, the cross-section of the handle may be of an "T" geometry, with the leg 86 of the "T" directed outwardly of the handle. Further, the weight of a filled container may dictate a handle having a minimum strength, thereby being an indicator of what material or geometrical cross section would be acceptable for forming the handle. Other suitable geometrical configurations of the handle will be recognized by one skilled in the art, given the present disclosure.

As desired, the handle may be of injection-molded plastic, or of a laminate of polymeric material, with or without the inclusion of paperboard as a part thereof. Preferably, the handle is formed from a plastic such as LDPE, HDPE, PP, OR MDPE.

Attachment of the opposite ends of the handle to the container is largely dependent upon the material from which the handle is formed. Ultrasonic welding may be suitable for certain plastics, while other materials of construction of the handle will be more suitably attached to the container by an adhesive. Again, depending upon the material of construction of the container and/or the handle, the handle may be integrally formed with the major panel of the gable top of the container.

Figure 12:
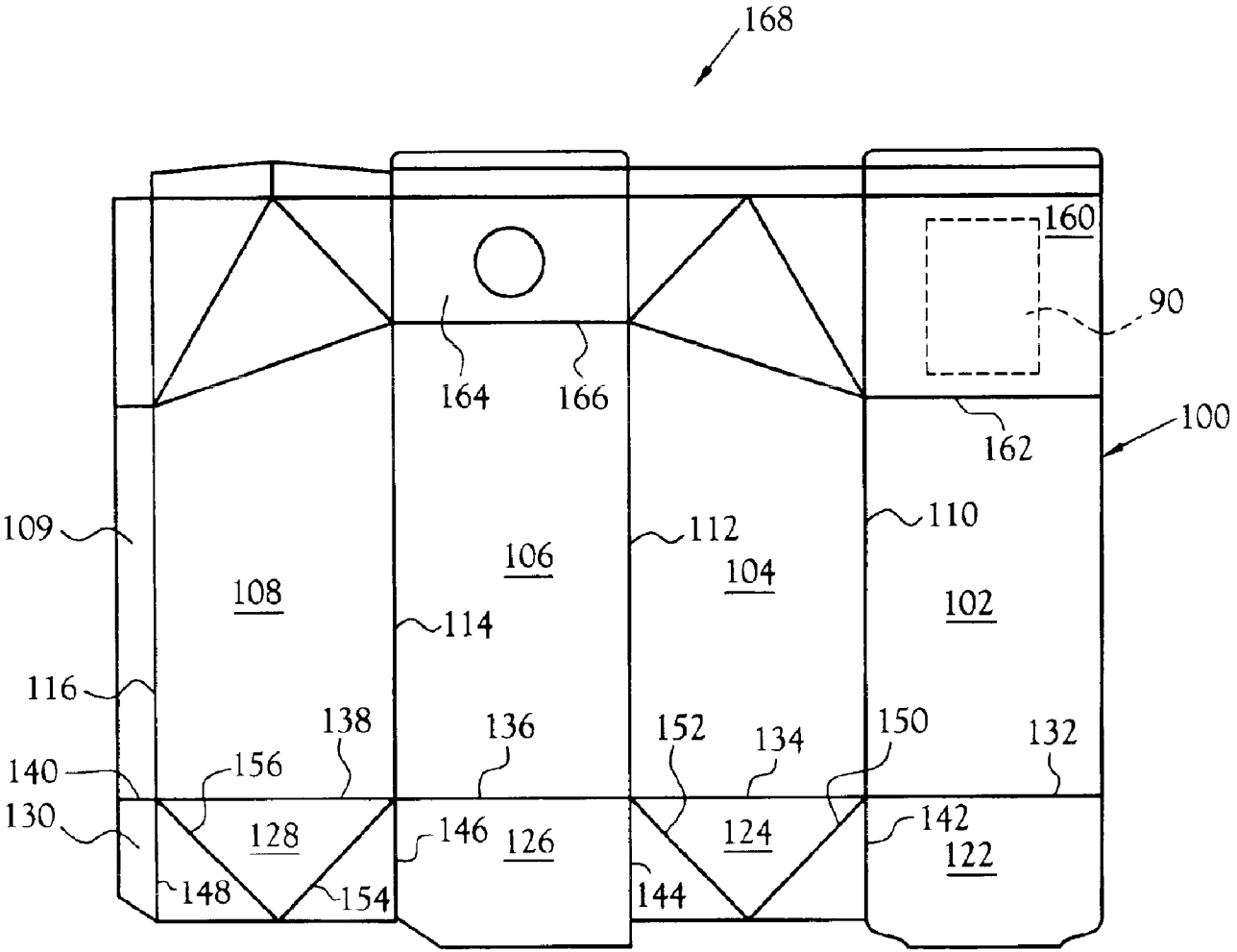
FIG. 12 is a laid-out view of a blank suitable for the formation of a container as depicted in FIG. 1.

With reference to FIG. 12, a suitable blank 100 for the formation of one embodiment of a container of the present invention, includes first 102, second 104, third 106, fourth 108, and fifth 109 side panels which are disposed in side-by-side relationship to one another and defined by fold lines 110, 112, 114 and 116. In the depicted blank, the bottom 120 of the container is formed from a plurality of panels 122, 124, 126 & 130, each of which is integral with its respective side panel, but defined by respective fold lines 132, 134, 136 & 140. Further, the individual ones of these panels are integrally formed with adjacent panels as by fold lines 142, 144, 146 & 148. The second and fourth panels 124, 128 are divided by fold lines 150, 152, 154 & 156 into triangular portions suitable for forming the common gusset folds found in conventional gable top containers.

The top end of the first side panel 102 is provided with a planar panel 160, integrally formed with the first side panel along a fold line 162. The third side panel 106 is likewise provided with a planar panel 164 which is integrally formed with the third side panel 106 along a fold line 164. Notably, the fold line for the first planar panel is disposed inwardly of the top end 168 of the blank by a distance between about 30% and 40% farther than the location of the fold line 166 between the third planar panel and the top end of the third side panel. The planar panels 160, 164 are of substantially equal length so that the aforedescribed locations of their respective fold lines relative to the top end of their respective side panels results in the planar panel 160 being of between about 30% and 40% greater area than the area of the planar panel 164, hence the planar panel 160 becomes the major top planar panel 14 and the planar panel 164 becomes the minor top planar panel 16 of the gable top of a container erected from the blank. Further, each of the planar panels 160, 164 includes a distal edge 165, 167, respectively, and a fin panel 169,171 integrally formed with a respective one of said distal edges, as by respective fold lines 173, 175. Upon erection of the blank into a container, these fin panels 169, 171 come together and are bonded in facing relationship to define the fin 48 of the erected container.

To form the container from the blank depicted in FIG. 11, the side walls are formed into a cylinder of rectangular (commonly square) cross section, and the bottom panels are folded and sealed to close the bottom end of the cylinder. Thereafter, the partially erected container is filled with a product, which most commonly is pourable and the top end panels of the first, second, third and fourth side panels are folded to define a gable top geometry which closes the top end of the container. Contrary to the prior art wherein the two planar panels which define the outer top surface of the closed container are of substantially equal widths such that the fin defined by the sealed side margins of these two panels is located centrally of the opposite side walls 40, 43 of the container, in the present container, the two top panels are of different widths such that the wider panel is deemed a major panel 14 and the panel of lesser width is deemed a minor panel 16. When the end margins of these two panels are sealed, the fin 48 is disposed "off center" of the top of the container i.e., laterally spaced apart from the longitudinal centerline 46 of the container (FIG. 2). In the present invention, preferably, a pour spout 22 is provided in the minor panel. On the opposite side of the fin and associated with the major panel there is anchored the handle 24 of the present invention.

From the several Figures, it will be recognized that the location of the handle of the present invention provides for ready grasping and holding of the container with one hand, and further provides a means by which the container, while so grasped in a single hand, may be selectively tilted to allow the contents of the container to flow out of the container via the pour spout under well-controlled conditions.

In this respect, it is noted that the handle of the present container is mounted on the major panel 14 which itself defines an angle "A" of less than about 60 degrees, and preferably between about 25 and about 45 degrees with respect to the longitudinal centerline 46 of the container. Thus, when the handle is grasped in one hand, the center of gravity of the filled container shifts to position the longitudinal centerline of the container at an angle of between about 20 and about 25 degrees with respect to the vertical. Inasmuch as most containers are not filled to their full capacity, this angle of inclination of the container is insufficient to cause the contents of the container to immediately pour from an open pour spout disposed on the minor panel of the gable top. However this angle is inclination is sufficiently great as permits the container to be further tilted relative to the vertical to controllably pour contents from the container via the pour spout.

Figure 14:
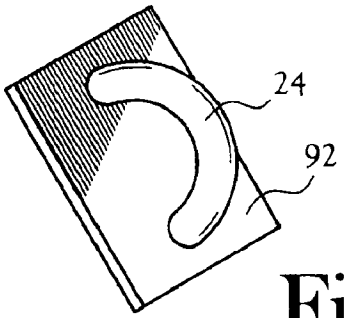
FIG. 14 is a perspective view of the handle and base depicted in FIG. 13; and, FIG. 15 is a sectional view taken generally along the line 15—15 of FIG. 13.
Figure 15:
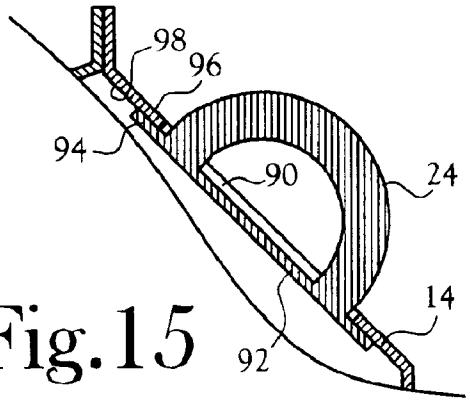
Figure 13:
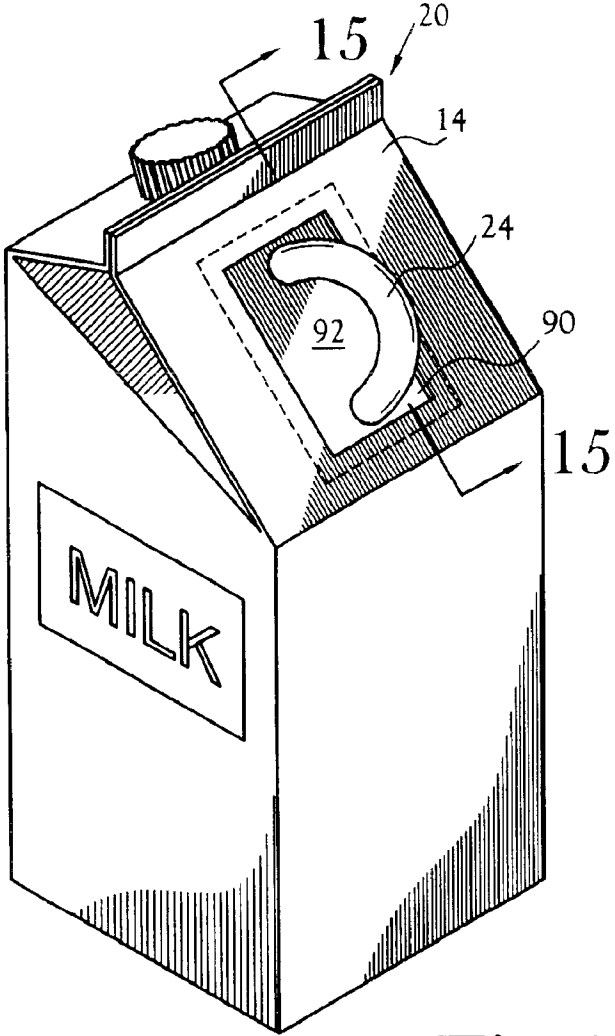
FIG. 13 is a perspective view of a gable top container embodying various of the features of the present invention and depicting an alternative embodiment of a handle having a base which is affixed to the top end of the container.

In one alternative embodiment of the present invention, the handle 24 may be provided with a planar base 92 such as depicted in FIGS. 13–15. In this embodiment of the handle, the blank 100 is provided with a rectangular opening 90 through the thickness of the major planar panel 14 as depicted in phantom in FIG. 11 and in perspective in FIG. 13. When the container is erected with its top end 20 open, the handle and its base is inserted into the interior of the container and the handle is passed through the opening in the major planar panel so that the handle projects outside the container as seem in FIG. 13. The base 92 is sized to be larger than the size of the opening 90 so that the perimetral margin 94 of the base engages the perimetral margin 96 of the opening 90 in position for the base to sealed to the interior surface 98 of the major planar panel 14 along the perimetral margin 96 of the opening, as depicted in FIGS. 13 and 15, thereby closing the opening and anchoring the handle in its attitude outside the container.

Among the many advantages provided by the handled container of the present invention is the ability to package multiple ones of the handled containers within a shipping case while exposing the handle of each of the cased containers in ready position for one to grasp a handle of a single container and withdraw the single container from the shipping case without having to move or otherwise manipulate the containers within the case to permit the grasping of the container by its sides or gable top. Aside from the ease of grasping of the container, the lack of any need to grasp the gable top itself materially reduces the possibility that grasping of the gable top itself may force the container to open with resultant spillage or contamination of the container contents.

Whereas specific examples have been provided for the handled container of the present invention, it will be recognized that modifications or alternatives are available and will be recognized by one skilled in the art. Thus, the invention is intended to be limited only by the Claims appended hereto.

What is claimed:

1. A handled container of the gable top variety having at least first, second, third and fourth side walls and a longitudinal centerline comprising a major rectangular planar panel, a minor rectangular planar panel, said major planar panel being dimensionally larger that said minor planar panel, said major and minor planar panels being sized and oriented to define at least an outer top surface of a gable top of the container and define a fin which extends substantially between opposite ones of the side walls of the container when the container is closed, an imaginary space defined above said major panel by projected extensions of the first, second and third side walls and a plane oriented substantially normal to the longitudinal centerline of the container and intersecting said projected extensions of the first, second and third side walls, said space having a generally truncated triangular cross section having its apex disposed adjacent said fin, and a handle associated with said major panel and disposed within said imaginary space.

2. The handled container of claim 1 wherein said handle is of an overall curved geometry having first and second ends and a body portion disposed therebetween, one of said first and second ends being anchored to said major panel at a location adjacent said fin and the other of said first and second ends being anchored to said major panel adjacent the intersection of said plane and said projected extension of that side wall of the container which is oriented parallel to said fin, said body portion of said handle being spaced apart from said major panel to define an opening suitable for the receipt of at least one finger of a users hand for manipulation of the container.

3. The handled container of claim 1 wherein said handle comprises an elongated central core having a plurality of individual oriented substantially normal to the length of said central core and spaced apart from one another along the length of said central core.

4. The handled container of claim 1 wherein said handle includes a plurality of discs aligned in stacked relationship to one another, each of said discs including one or more perimetral aberrations disposed on the outer perimetral surface of one or more of said discs.

5. The handled container of claim 1 wherein said major planar panel is disposed in a plane which is oriented at an angle of between about 20 and about 25 degrees with respect to the longitudinal centerline of the container.

6. The handled container of claim 1 wherein said handle exhibits a continuously curving geometry from end to end thereof.

7. The handled container of claim 1 wherein said handle exhibits a multi-segmented geometry from end to end thereof.

8. The handled container of claim 1 and including a pour spout associated with said minor planar panel.

9. The handled container of claim 1 wherein no material portion of said handle projects beyond the footprint of the container.

10. The handled container of claim 1 wherein said handle is formed from a polymeric material or paperboard.

11. The handled container of claim 1 wherein said handle includes first and second opposite ends and a body portion extending between said ends, said body portion being aligned with the longitudinal centerline of the container.

12. The handled container of claim 1 wherein said handle includes first and second opposite ends and including a substantially planar base affixed to said first and second opposite ends, said base being adapted to be anchored to said major planar panel with said handle projecting outwardly from said major planar panel.

13. The handled container of claim 12 and including an opening defined through the thickness of said major planar panel and said base is disposed internally of said container and in covering relationship to said opening and with said handle projecting through said opening and outwardly from said major planar panel.

14. The handled container of claim 13 wherein said base is sealed about its outer perimetral margin to the perimetral margin of said opening.

15. The handled container of claim 14 wherein said base is disposed internally of said container.

16. The handled container of claim 14 wherein said base is ultrasonically welded to said major planar panel.

17. The handled container of claim 1 wherein said panels are formed from paperboard.

* * * * *